US009126077B2

(12) United States Patent
Rothacker

(10) Patent No.: US 9,126,077 B2
(45) Date of Patent: Sep. 8, 2015

(54) METHOD AND APPARATUS FOR INCREMENTALLY INCREASING STRENGTH

(76) Inventor: Alexander M. Rothacker, Wildwood, IL (US)

( * ) Notice: Subject to any disclaimer, the term of this patent is extended or adjusted under 35 U.S.C. 154(b) by 0 days.

(21) Appl. No.: 13/448,335

(22) Filed: Apr. 16, 2012

(65) Prior Publication Data

US 2013/0274073 A1 Oct. 17, 2013

(51) Int. Cl.

| | |
|---|---|
| ***A63B 21/00*** | (2006.01) |
| ***A63B 21/06*** | (2006.01) |
| ***A63B 21/062*** | (2006.01) |
| *A63B 21/072* | (2006.01) |

(52) U.S. Cl.

CPC ..... *A63B 21/062* (2013.01); *A63B 21/0728* (2013.01); *A63B 21/0724* (2013.01); *A63B 2021/0623* (2013.01); *A63B 2209/08* (2013.01)

(58) Field of Classification Search

CPC ..... A63B 21/00058; A63B 21/0006; A63B 21/00065; A63B 21/06; A63B 21/0601; A63B 21/0702; A63B 21/02

USPC ..... 482/92, 93, 148, 98, 106–108

See application file for complete search history.

(56) References Cited

U.S. PATENT DOCUMENTS

| | | | | |
|---|---|---|---|---|
| 2,731,663 | A * | 1/1956 | Thompson | 16/422 |
| 3,825,253 | A | 7/1974 | Speyer | |
| 4,013,293 | A * | 3/1977 | Hess et al. | 273/239 |
| 4,326,720 | A * | 4/1982 | Erlich | 273/239 |
| 4,444,396 | A | 4/1984 | Wendt | |
| 4,602,788 | A | 7/1986 | Wendt | |
| 4,685,675 | A | 8/1987 | Heiman | |
| 4,722,523 | A * | 2/1988 | Yang | 482/108 |
| 4,971,305 | A * | 11/1990 | Rennex | 482/93 |
| 5,011,138 | A | 4/1991 | Rankin | |
| 5,348,522 | A * | 9/1994 | Brotman | 482/98 |
| 5,393,285 | A * | 2/1995 | Fischer et al. | 482/108 |
| 5,735,777 | A * | 4/1998 | Benoit et al. | 482/93 |
| 5,738,613 | A | 4/1998 | Clayton | |
| 6,186,904 | B1 | 2/2001 | Bass | |
| 6,193,635 | B1 | 2/2001 | Webber et al. | |
| 6,387,021 | B1 | 5/2002 | Miller | |
| 7,588,519 | B2 * | 9/2009 | McClusky | 482/93 |
| 7,780,582 | B2 * | 8/2010 | Anderson | 482/107 |
| 2003/0040407 | A1 * | 2/2003 | Rothacker | 482/106 |
| 2007/0197352 | A1 * | 8/2007 | Charniga et al. | 482/93 |
| 2007/0298940 | A1 * | 12/2007 | Anderson | 482/107 |

(Continued)

OTHER PUBLICATIONS

Choice 1 Medical Distributions, "New Equipment Product Info: Hausmann Pulley Weights," (2000). Retrieved from the Internet on Nov. 15, 2006: URL:http//www.c1md.com/eqiupnew5.asp?ID=1007558.

(Continued)

*Primary Examiner* — Stephen Crow
*Assistant Examiner* — Garrett Atkinson
(74) *Attorney, Agent, or Firm* — Marshall, Gerstein & Borun LLP

(57) ABSTRACT

A micro-weight training apparatus can include one or more disc-shaped micro-weights. The micro-weight can include an annular body defining a substantially central aperture extending entirely through the annular body, wherein the annular body comprises first and second surfaces, with each surface terminating in a radiused edge. The micro-weight further includes a magnet disposed in the aperture. The micro-weight can have a mass in of about ¼ ounce to about 2 ounces.

17 Claims, 7 Drawing Sheets

(56) References Cited

U.S. PATENT DOCUMENTS

| | | | | |
|---|---|---|---|---|
| 2008/0081744 | A1* | 4/2008 | Gormley | 482/93 |
| 2008/0153678 | A1* | 6/2008 | McClusky | 482/106 |
| 2009/0048080 | A1* | 2/2009 | Daniel | 482/107 |
| 2010/0075816 | A1* | 3/2010 | Anderson | 482/107 |
| 2010/0210427 | A1* | 8/2010 | Yu | 482/93 |
| 2010/0285937 | A1* | 11/2010 | Anderson | 482/107 |

OTHER PUBLICATIONS

PlateMate Product Information, "PlateMate®," (2002). Retrieved from the Internet on Aug. 6, 2003: URL:http://www.theplatemate.com/products.htm.

Smith, "Pumping Iron Jr.," Time Magazine (2001).

* cited by examiner

METHOD AND APPARATUS FOR INCREMENTALLY INCREASING STRENGTH

BACKGROUND

1. Field of the Disclosure

The present disclosure is directed to a method and apparatus for incrementally increasing strength, and more particularly to a method and apparatus for incrementally increasing strength that include one or more magnetic, stackable micro-weights.

2. Brief Description of Related Technology

The use of weights and other forms of resistance for weight training is well-known. Typically, a desired resistance for weight training is produced by loading a standard barbell with standard weights or by selecting a desired weight resistance on a cable-type weight training apparatus. Generally, increments of less than one and one quarter pounds are not available for adjusting the weight resistance of a standard barbell, and increments of less than five pounds are not available for adjusting the weight resistance of a cable-type weight training apparatus. Accordingly, while incremental weight systems for weight training have been disclosed, the smallest weight increment available for adjusting a desired exercise resistance of conventional barbell and cable systems is typically at least one and one quarter pounds. This is a substantial increase in exercise resistance, which could subject a user to considerable risks of injury. Typical injuries caused by weight lifting include tendon and ligament injuries. Tendons and ligaments are generally unable to handle such relatively larger increases in weight resistance as compared to muscle tissue. Thus, a user is often susceptible to tendon and ligament injury when increasing weight in conventional systems. Additionally, as a result of receiving approximately three to four time less blood flow than muscles, tendons and ligaments generally build in strength about three to four times slower than muscles.

Incremental weight increases smaller than one and one quarter pounds have been disclosed for use in some athletic training methods. For example, U.S. Pat. No. 4,444,396 discloses a weighted golf swing exercise club including a set of circular disks comprising one-ounce, two-ounce, four-ounce, eight-ounce, and sixteen-ounce weights. According to this patent, a golfer can strengthen muscles used in golf and reduce the risk of injury by practicing with (and gradually increasing the weight of) the weighted golf swing exercise club. The device is particularly designed to simulate a golf club. The device includes a regulation golf-club length shaft and grip and the weights are attached to an opposed end of the shaft, where the head of a golf club would otherwise be located.

More recently, weight increments less than one and one quarter pounds have been discussed in the context of more conventional weight training methods. For example, Ian K. Smith, M. D., advocates that a child's exercise intensity be increased in one or two pound increments. (See Ian K. Smith, M. D., *Pumping Iron Jr.*, Time, Mar. 5, 2001, at 81.) However, a one or two pound increase in exercise resistance is often too large of an increase for adults, and such an increase in exercise resistance is proportionally larger for children. Undertaking such large increases in resistance results in increased risk of muscle, tendon, and/or ligament injury.

Commercially available weight lifting products such as the PlateMate® Hex and the PlateMate® Donut, which are available in increments ranging in weight from ⅝ pounds to 2.5 pounds, have been designed to address this problem. The vendor advocates that strength training with such incremental increases is a smarter and safer way to successful strength training that allows weight lifters to break through "the plateau" to achieve the highest level of success in weight training. However, the lowest available PlateMate® weight increment of ⅝ pounds is too large of a weight increase for most adult muscle groups, and is certainly too large of an increase for both children and persons rehabilitating injuries. Furthermore, if the lowest PlateMate® weight increment is to be used with a standard barbell, a weight lifter must increase exercise resistance by two times ⅝ pounds or by one and one quarter pounds. As previously discussed, this is a substantial increase in exercise resistance, and a weight lifter risks muscle, tendon, and/or ligament injury by undertaking such a large increase.

Additionally, it would be difficult if not impossible for a weight lifter to continuously increase exercise resistance between workouts by one and one quarter pounds or even by ⅝ pounds. If a weight lifter attempted to continuously increase exercise intensity between workouts by such an amount, the weight lifter's form will eventually deteriorate because of the additional weight, and the weight lifter's risk of injury will increase. Further, the PlateMate® weight products are not capable of stacking upon one another. Thus, because one cannot stack PlateMate® weight products upon one another, weight increments other than those directly available from the vendor cannot be used.

Additionally, removal of the PlateMate® weight from a plate weight, for example, can be difficult for a user, particularly youths and older users. The PlateMate® weight includes multiple magnets extending outwardly and disposed circumferentially about the weight. The user must magnetically decouple the PlateMate® weight from a standard plate weight by placing their fingers between the PlateMate® weight and the plate weight to disrupt the attractive force between PlateMate® weight and the plate weight. This often results in undesirable and sometimes painful pinching of the user's fingers between the magnet and the plate weight.

U.S. Patent Application Publication No. 2003/0040407 describes an incremental weight training apparatus that includes weighted disks having a central aperture adapted to receive a standard Olympic barbell and a slot extending from the center aperture to the perimeter of the disk adapted to fit onto a cable-type weight training apparatus. Such disk weights are not easily and securely attached to a weight training system, particularly when one or more of the disk weights are used in combination. For example, when applied to a barbell weight lifting apparatus a collar or other securing means is typically required to retain the disk weights and the plate weights on the bar. This, in turn, makes the removal or additional incremental adjustment of the disk weights more difficult, as the collar must first be removed and the disk weights removed from an end of the bar.

SUMMARY

In accordance with an embodiment of the disclosure, a micro-weight training apparatus includes one or more disc-shaped micro-weights. Each micro-weight includes an annular body defining a substantially central aperture extending entirely through the annular body and a magnet disposed in the aperture. The annular body includes first and second substantially coplanar surfaces and each surface terminates in a radiused edge. The micro-weights each have a mass of about ¼ ounce to about 2 ounces.

In accordance with an embodiment of the disclosure, a method of incrementally increasing a person's strength by incremental weight training includes selecting an initial resistance and executing a weight training exercise using the initial resistance. The method further includes magnetically attaching one or more micro-weights having an incremental mass of about ¼ ounce to about 2 ounces to the initial resistance and subsequently executing the weight training exercise, thereby achieving small incremental gains in strength without causing injury and/or failure. The micro-weight includes an annular body defining a substantially central aperture extending entirely through the annular body and a magnet disposed in the aperture. The annular body comprises first and second substantially coplanar surfaces, each surface terminating in a radiused edge.

The method of executing a weight training exercise using the micro-weights of the disclosure can further include, for example, magnetically attaching a second micro-weight to the initial resistance and/or (directly to) the first micro-weight to further incrementally increase the exercise resistance for subsequent execution of the weight training exercise, thereby achieving further incremental gains in strength without causing injury and/or failure. In this embodiment, because the aperture extends entirely through the annular body, the magnet disposed therein includes two exposed magnetic poles, each capable of magnetically coupling to a plate weight and/or another micro-weight to allow for stacking. The magnetic poles of the magnets of the first and second micro-weights align the micro-weights when stacked.

DETAILED DESCRIPTION

Figure 1:
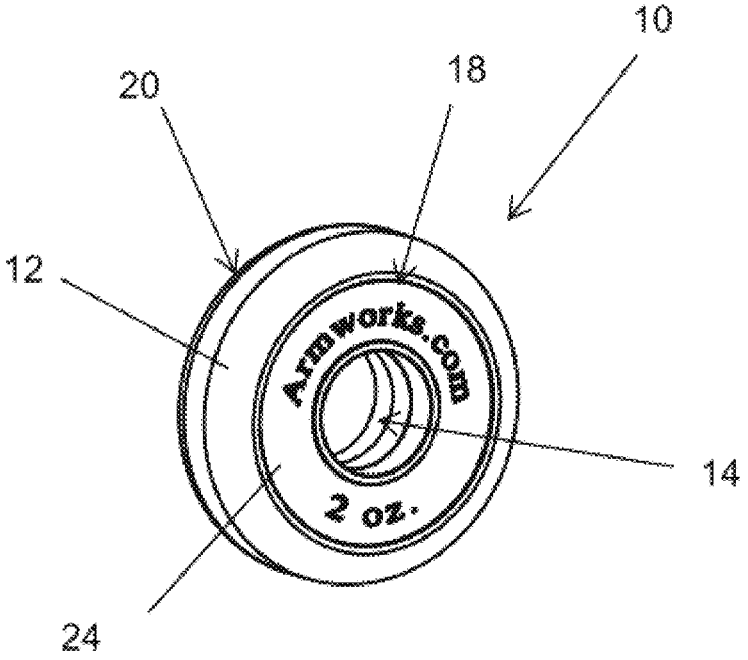
FIG. 1 is a perspective view of a micro-weight in accordance with an embodiment of the disclosure.

Disclosed herein are micro-weights and methods for incrementally increasing strength. The micro-weights are capable of magnetically attaching to any conventional weight training apparatus to provide smaller increments of increased mass to slowly and safely strength muscles, tendons, and ligaments. A set for incrementally increasing strength can include one or more micro-weights in accordance with the disclosure.

To build the strength of tendons, ligaments, and muscles safely and without injury or substantial risk of injury, small, incremental increases in weight and, thus, exercise intensity, should be observed. Tendons, ligaments, and muscles are able to handle small incremental increases in weight without the substantial risk of injury observed with large, conventional increases in weight. The micro-weights of the disclosure advantageously provide an incremental weight system having small weight increments to reduce a weight lifter's risk of injury. The small increments of increased resistance provided by the micro-weights of the disclosure can beneficially allow a weight lifter to make consistent weight lifting gains and achieve strength training goals.

Further, by using small incremental increases in exercise resistance, a user can increase exercise intensity without sacrificing good weight training form. As exercise resistance is increased, it is necessary to monitor and maintain the user's weight lifting form and movement. By monitoring these indicia of weight training performance, one can determine if the increase is an appropriate increase in exercise intensity. If the user's form deteriorates or the movement becomes rushed or non-continuous, a smaller increase in exercise intensity is needed. The micro-weights of the disclosure allows for small, for example, as small as ¼ ounce, increments in weight increase, which beneficially allows for increasing exercise intensity slowly and without sacrificing form and movement. This in turn can beneficially allow a user to achieve an overall weight increase that would otherwise be unachievable with conventional weight systems before the user reached a plateau. Typically, plateau occurs when the increase in exercise intensity becomes too large for a person's tissue to handle. By providing such small incremental weight, however, the micro-weights and methods of the disclosure advantageously allow for slow strengthening with continued incremental increases in exercise intensity and without plateau. As a result, a user can continually achieve strength goals, which can make going to the gym and working out more satisfying, both physically and mentally.

The micro-weights and methods of the disclosure allow the user to increase the exercise intensity in a controlled manner to allow the user to increase muscle size and strength without failure and/or injury. Additionally, by practicing the methods in accordance with the disclosure, some users may identify a weight increment that allows the user to continuously increase exercise intensity between workouts without causing muscle failure and without reaching plateau, which prevent continued strength gain. As the exercise resistance is continually increased over time, each incremental increase in weight becomes a smaller percentage of the total exercise resistance, which can beneficially aid in continued and safe strength gain. Additionally, the micro-weights of the disclosure can include varying increments of weight and/or be combined for different increments of weight, which allows the user to tailor the incremental increases to ensure continued strength gain without injury or failure.

Figure 6:
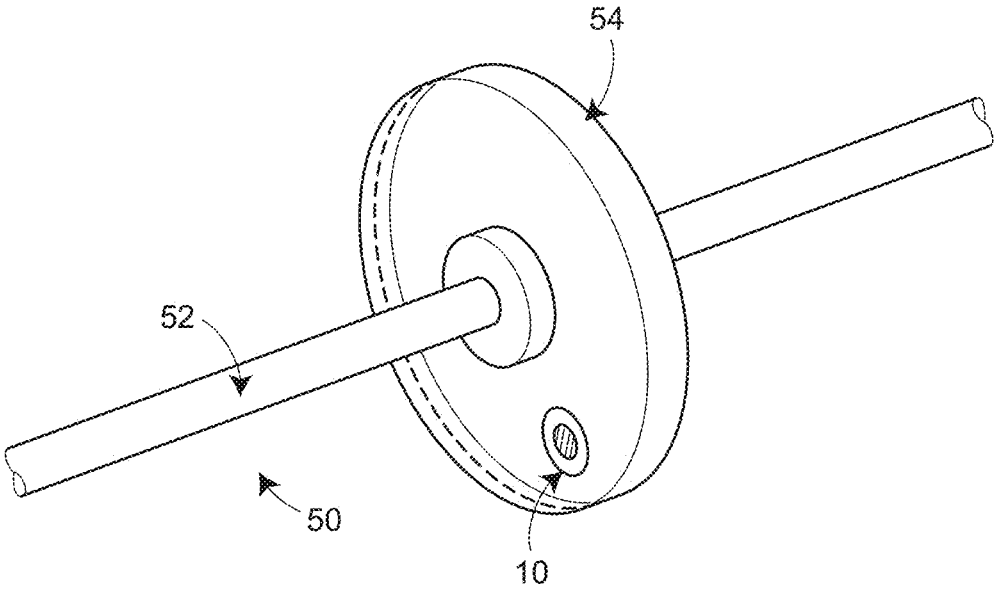
FIG. 6 is a schematic illustration of a portion of a standard barbell weight lifting apparatus, illustrating a micro-weight in accordance with an embodiment of the disclosure magnetically attached to a barbell weight.
Figure 7:
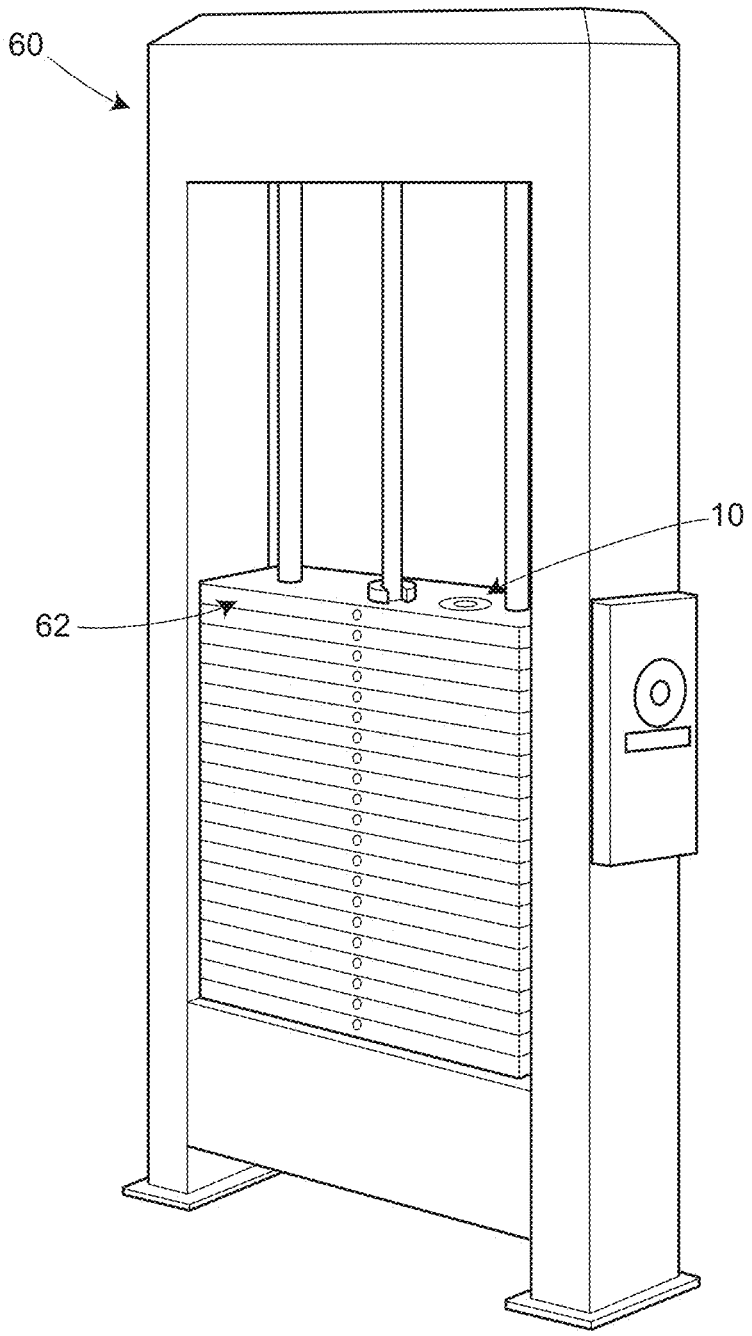
FIG. 7 is a schematic illustration of a portion of a cable-type weight apparatus, illustrating a micro-weight in accordance with an embodiment of the disclosure magnetically attached to a plate weight.

The micro-weights of the disclosure are adapted for use with any weight lifting apparatus, including both a standard barbell and a cable-type weight training apparatus. FIGS. 6 and 7, for example, illustrate a micro-weight 10 in accordance with the disclosure attached to a plate weight of a conventional barbell weight lifting apparatus and to a plate of a cable-type weight lifting apparatus, respectively. The micro-weights of the disclosure can be easily and securely applied to and removed from a plate weight, and provide versatility in the amount of incremental weight that can be applied by allowing for and facilitating stacking of the incremental weights. As described in detail below, the micro-weights include one or more magnets disposed in a central aperture of the micro-weight, with magnetic poles of the magnet(s) exposed on each side surface of the micro-weight. Thus, each side surface of the micro-weight is capable of magnetically coupling to a plate and/or another micro-weight via the exposed magnetic pole. The centrally disposed magnet of the micro-weights allows the micro-weights to be easily and securely stacked. When stacking micro-weights, the magnets of stacked micro-weights align along their magnetic poles, which are substantially centrally disposed in the micro-weight, thereby automatically aligning the stacked micro-weights. The stacking feature of the micro-weights allows for versatility in the incremental weight increases used to allow a user to individually tailor their strength training program to allow for safe and consistent strengthen of muscles without or with significantly reduced risk of tendon and ligament injury often associated with conventional weight lifting systems.

The micro-weight in accordance with embodiments of the disclosure can have a mass of about ¼ ounce to about 2 ounces. For example, the micro-weight can have a mass of about ¼, ½, ¾, 1, 1¼, 1½, 1¾, and 2 ounces. The micro-weight can have any other suitable mass. A set of micro-weights can include any combination of micro-weights having any suitable masses and increments of masses. For example, the set can include a pair of ¼ ounce micro-weights that can be placed on plate weights disposed on opposite ends of a barbell to incrementally increase the exercise resistance by ½ ounce, or for stacking the two ¼ ounce micro-weights on a plate weight of a cable-type weight training apparatus. Alternatively, the set can include a ½ ounce micro-weight and the ½ ounce incremental increase can be achieved in a cable-type weight training apparatus by attaching the ½ ounce micro-weight to the plate weight. Similarly, a one-ounce increase in exercise intensity can be obtained by using two one half-ounce micro-weights with a standard barbell weight training apparatus, or by adding a one-ounce micro-weight to a weight bearing cable of a cable-type weight training apparatus. The magnetic stackability of the micro-weights provides versatility to the users in determining suitable incremental increases for safe and effective strength training.

The set of micro-weights can include one or more micro-weights have any suitable mass and size as described above. The set of micro-weights can include any number of micro-weights to provide for incremental increases in strength training. For example, the set of micro-weights can include 1, 2, 3, 4, 5, 6, 7, 8, 9, 10, 11, 12, 13, 14, 15, 16, 17, 18, 19, 20, or more micro-weights.

Figure 5:
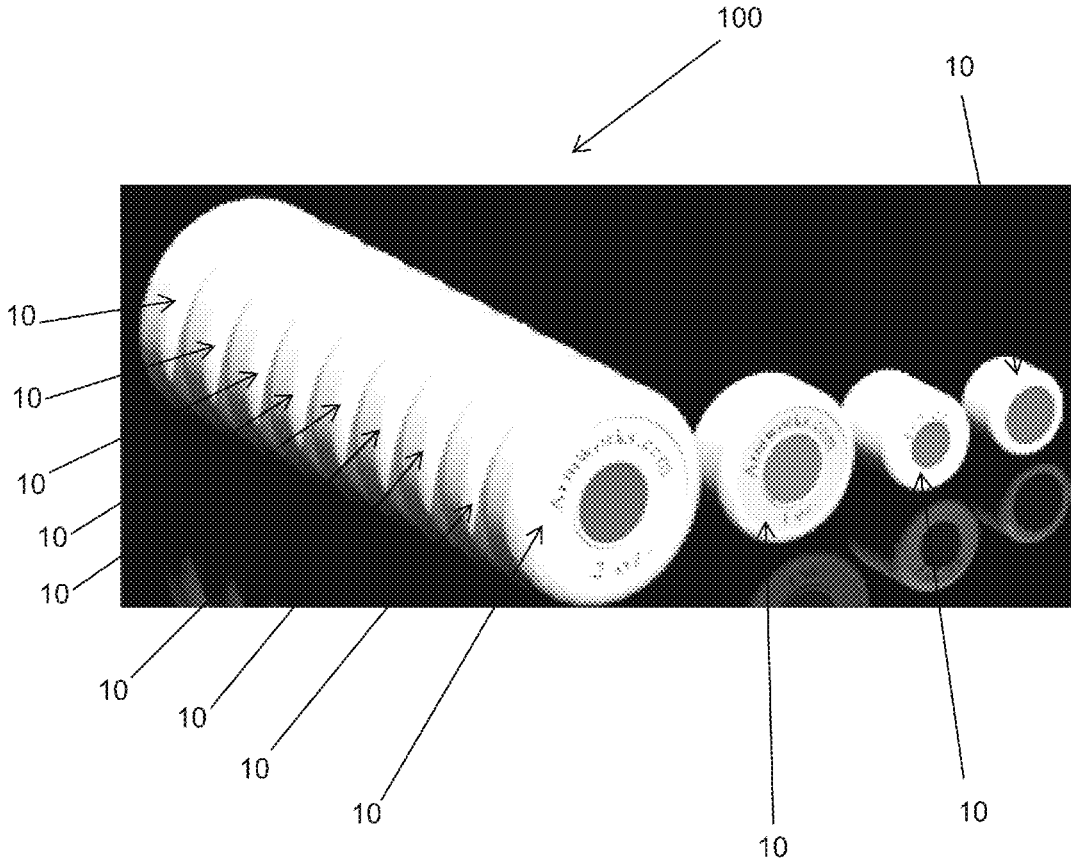
FIG. 5 is a schematic illustrating micro-weights of different weights and sizes, and multiple, stacked micro-weights in accordance with the disclosure.

The set of micro-weights can include any combination of masses of micro-weights or can include micro-weights having the same mass. The set of micro-weights can have any suitable range of micro-weights. For example, the micro-weights of the set can range from ¼ ounce to 2 ounce, from ½ ounce to 2 ounces, from 1 ounce to 2 ounces, from ¼ ounce to 1 ounce, or any other incremental range between ¼ ounce and 2 ounce. In some embodiments, the set can include multiple micro-weights, each having the same mass. For example, the set in accordance with embodiments of the disclosure can include pairs of micro-weights having the same mass so that balanced incremental mass can be added to each side of a lifting apparatus, such as a dumbbell. In one embodiment, for example, the set includes a pair of ¼ ounce micro-weights, a pair of ½ ounce micro-weights, a pair of one ounce micro-weights, and a pair of two ounce micro-weights. In yet another embodiment, the set includes micro-weights ranging from ¼ ounce to 2 ounces, provided in increments of ¼ ounce. The sets can include other incremental ranges of micro-weights, for example, ranging in increments of ¼ ounces, ½ ounces, and/or ¾ ounces. In another embodiment, as illustrated in FIG. 5, a set can include twelve total micro-weights, of which nine of the micro-weights have a mass of 2 ounces each, one micro-weight has a mass of one ounce, one micro-weight has a mass of ½ ounce, and one micro-weight has a mass of ¼ ounce. This set of micro-weights can provide a wide variety of incremental increases by stacking the micro-weights. In particular, this embodiment can provide incremental increases in mass of from ¼ ounce to 19¾ ounces.

The micro-weights and sets of micro-weights in accordance with the disclosure allow for a wide variety of incremental increases, for example by magnetically attaching multiple micro-weights to a weight training apparatus and/or stacking micro-weights and attaching the stack of micro-weights to the weight training apparatus.

Micro-Weights

Referring to FIG. 1, a micro-weight 10 according to embodiments of the disclosure includes an annular body 12 having a substantially centrally disposed aperture 14 extending through the annular body 12 and a magnet 16 (not shown in FIG. 1) disposed in the aperture 14. In various embodiments, the aperture can extend through the entire annular body, such that opposed poles of the magnet disposed in the aperture are exposed on opposed surfaces of the annular body, thereby allowing magnetic coupling of the micro-weight to a plate weight or another micro-weight on either surface of the micro-weight. In alternative embodiments, a pair of apertures can extend partially through the annular body, each originating, respectively, from opposed surfaces of the annular body and terminating in a dividing wall disposed between the pair of apertures. In this embodiment, a pair of magnets is disposed in the pair of apertures such that a pole of each magnet is exposed on the, respective, surface of the annular body for coupling to a conventional plate weight and/or another micro-weight from either or both of the surfaces, thereby allowing for and facilitating stacking of the micro-weights. The magnets are disposed in the pair of apertures such that opposed poles of the magnets face the dividing wall and the magnets attract one another through the dividing wall.

The aperture 14 can have any suitable cross-sectional shape, for example, circular, square, elliptical, rectangular, triangular, hexagonal, or any other polygon. The magnet typically has a substantially complementary shape to the aperture. In one embodiment, the aperture 14 is cylindrically shaped. The aperture can also have any suitable diameter. In various embodiments, the aperture 14 and the magnet 16 have substantially the same diameter to allow the magnet to be press-fit into the annular body, as discussed in further detail below.

By allowing for and facilitating magnetic stacking of the micro-weights, the micro-weights of the disclosure provides a wide range of versatility in the amount of weight that can be incrementally and securely added to an initial starting resistance. Micro-weights having the same or different masses can be stacked to particularly tailor the desired incremental increase for the user. For example, a set of micro-weights can be provided with a ¼ ounce micro-weight, a ½ micro-weight, and a 1 ounce micro-weight. A user can combine the micro-weights as needed to achieve incremental increases of 1½ ounces, for example. In another embodiment, a set of micro-weights can include one or more pairs of micro-weights, with each of the micro-weights of a pair having the same mass. Such sets are particularly useful with barbell-type weight training apparatuses that require balanced incremental increases in weight. This can allow the user more flexibility in tailoring the incremental increases in exercise resistance over the course of the strength building program. Generally, as the exercise resistance increases, the incremental increases in weight may need to be reduced to allow for safe strengthening of muscles, tendons, and ligaments without injury or failure. Stacking of the micro-weights allows the user to individually tailor the incremental increases and alternatively to decrease the incremental increases, as needed.

Figure 2A:
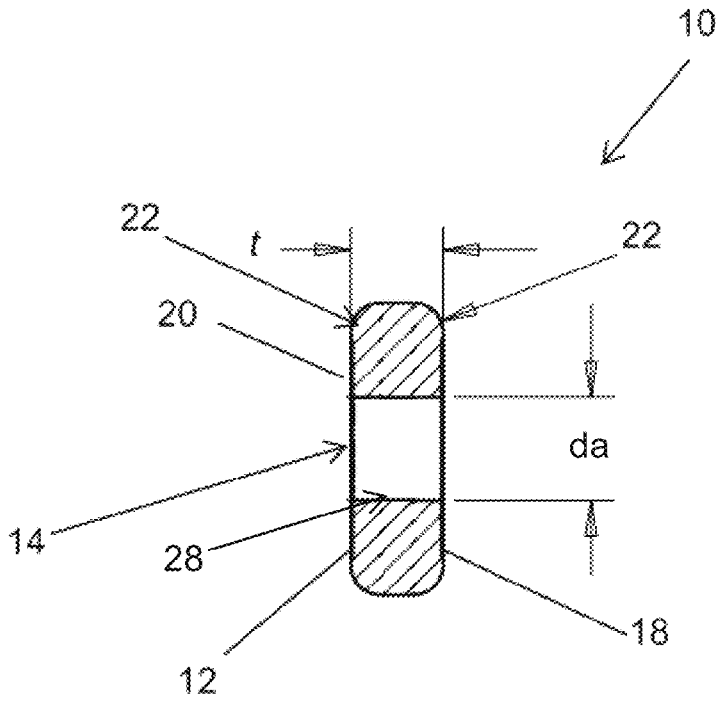
FIG. 2A is a side cross-sectional view of a micro-weight in accordance with an embodiment of the disclosure, illustrating the micro-weight without a magnet disposed in the aperture.
Figure 2B:
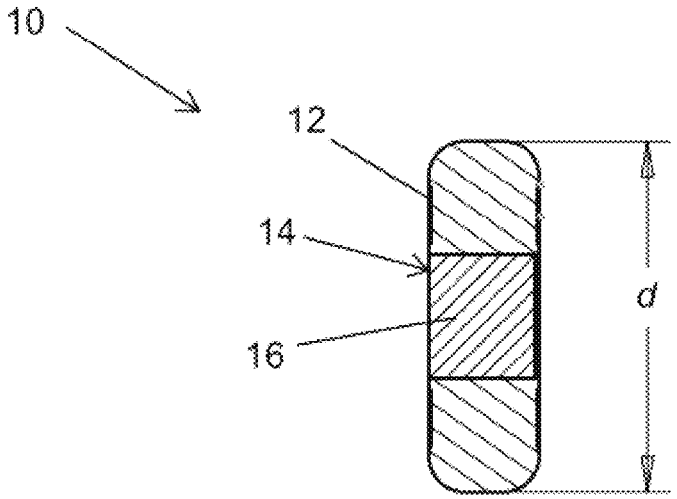
FIG. 2B is a side cross-sectional view of the micro-weight of FIG. 2A, illustrating the magnet in the aperture.

The thickness and diameter of the micro-weights can be varied depending on the mass of the micro-weight. Referring to FIG. 2A, the micro-weight 10 can have a thickness t, for example, of about 0.1 inches to about 1 inch, about 0.3 inches to about 0.6 inches, and about 0.3 to about 0.4 inches. For example, the micro-weight can have a thickness of about 0.32, 0.39, or 0.55 inches. Referring to FIG. 2B, the micro-weights can have a diameter d of about 0.1 inch to about 5 inches, about 0.5 inches to about 2 inches, and about 0.45 inches to about 1.5 inches. For example, the micro-weight can have a diameter of about 0.475, 0.55, 0.868, or 1.24 inches.

The Annular Body

The annular body 12 can be formed of a non-magnetic material. For example, the annular body 12 can be formed of stainless steel. Forming the annular body 12 of a non-magnetic material advantageously allows the centrally disposed magnet 16 having a centrally disposed magnetic pole to automatically align the micro-weights both axially and concentrically along the magnetic pole when micro-weights are stacked. Forming the annular body 12 of stainless steel or other oxidation resistant material can also beneficially lengthen the life span of the micro-weight by preventing damage due to oxidation and/or rust on the surface of the annular body 12. Use of such materials also advantageously eliminates the need to coat or otherwise paint the micro-weights with a protective coating/paint. Optionally, the micro-weights can be formed of non- or low-oxidation resistant materials and be coated or painted with a protective coating. In various embodiments, the micro-weights can be painted, whether for imparting oxidation and/or abrasion resistance or for aesthetic purpose or both.

The annular body 12 has first and second surfaces 18, 20, each surface terminating in a radiused edge 22 (also referred to herein as "the outer edge" or "the radiused outer edge"). The large radius of the radiused edge 22 of the annular body 12 advantageously provides for easier attachment to and separation of one micro-weight 10 from a weight training apparatus and/or another micro-weight 10. In particular, the large radius provides a smoother, round surface at which the user can insert their fingers between stacked micro-weights to separate the weights without the micro-weights pinching the user's fingers. Additionally, during attachment of the micro-weight 10 to a weight training apparatus and/or another micro-weight 10 the large radiused edge 22 provides a smooth surface that the user's finger can easily slide over to avoid pinching of the finger as the plates magnetically attract. The radiused edge 22 can have a radius of about 0.01 rads to about 0.2 rads, about 0.01 to about 0.1, and about 0.04 to about 0.15. For example, the radius of the radiused edge 22 can be about 0.0480 rads, about 0.078 rads, about 0.093 rads, or about 0.125 rads.

One or both of the first and second surfaces 18, 20 of the annular body 12 can further include a recessed portion 24 extending between the radiused edge 22 and aperture 14, such that it does not traverse all of the way from the aperture to the radiused edge. For example, portions of the annular body surrounding the aperture and adjacent the radiused edge can be substantially coplanar, and the recessed portion 24 can extend between and be recessed relative to these portions of the annular body. The recessed portion 24 can have a diameter as measured from the center of the micro-weight 10 to the outer circumferential edge of the recessed portion 24 of 0.05 inch to about 4.95 inches, about 0.5 inches to about 2 inches, and about 0.1 to about 1 inch. In one embodiment, the recessed portion 24 has a diameter of about 0.938 inches.

The recessed portion 24 can include, for example, engraving or printing that provides the mass of the micro-weight 10 and/or product name and/or company information. Having a recessed face can advantageously protect the indentifying information from scratching and/or wearing when micro-weights are attached to and/or separated from a weight training apparatus or another micro-weight 10. The recessed portion 24 can be recessed relative to the radiused edge 22 by 0.001 inches to about 0.01 inches, about 0.003 inches to about 0.009 inches, about 0.004 inches to about 0.008 inches, and about 0.005 inches to about 0.007 inches. Other suitable recess distances include, for example, about 0.001, 0.002, 0.003, 0.004, 0.005, 0.006, 0.007, 0.008, 0.009, and 0.01 inches.

The Magnet

Figure 3:
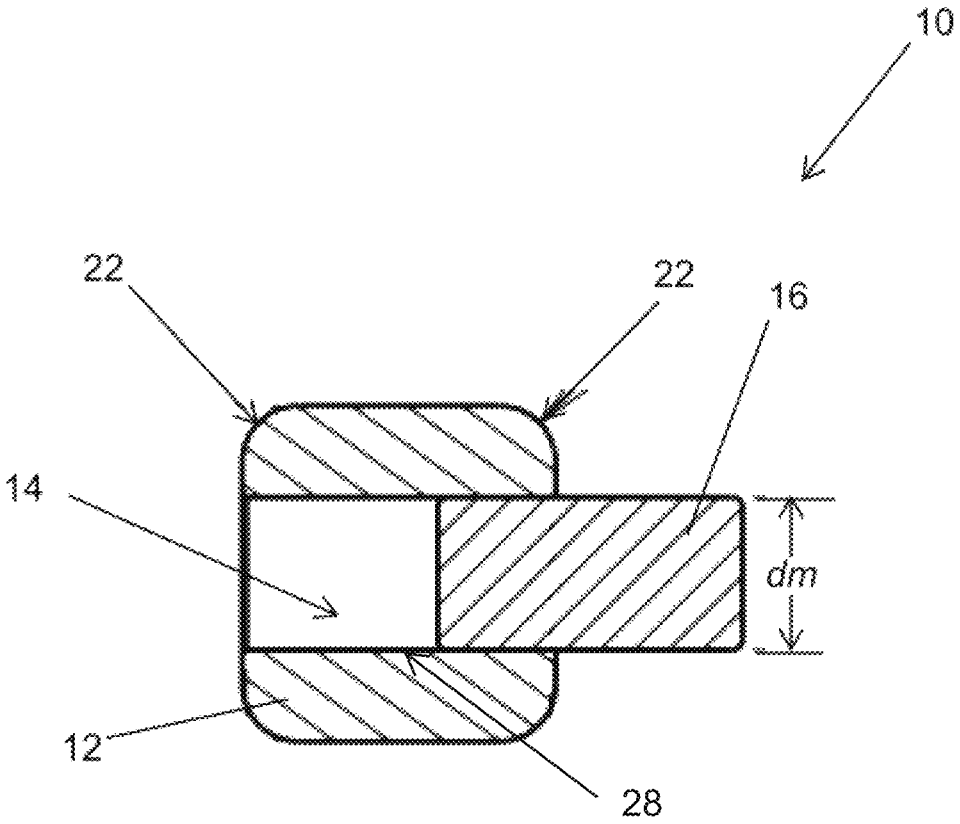
FIG. 3 is a side cross-sectional view of a micro-weight in accordance with an embodiment of the disclosure, illustrating placement of the magnet into the aperture and a magnetic for insertion therein.

Referring to FIGS. 2B and 3, the magnet 16 is disposed in the aperture 14 such that magnetic poles are exposed on opposed side surfaces of the micro-weight. As described above, in an alternative embodiment where the aperture does not extend through the entire annular body, a pair of magnets can be disposed in a pair of apertures, such that magnetic poles are exposed on opposed surfaces of the micro-weight. In either embodiment, the magnet or magnets are substantially centrally disposed in the annular body. The substantially centrally disposed magnet 16 (or magnets) having exposed magnetic poles on both side surfaces of the micro-weight allows the micro-weights to be attached to a variety of conventional weights and weight lifting apparatus, as well as advantageously allows the micro-weights to be easily stacked to be used in combination for incremental training. The magnets of the micro-weights are centrally disposed in the annular body 12, which allows the micro-weights to automatically align when stacked. The self-aligning capability of the micro-weights can make the micro-weights of the disclosure easy to use for any user including youths and the elderly, who may otherwise have difficulty applying and removing conventional incremental weight systems like the PlateMate® weight, which can detrimentally pinch the fingers of the user when the user applies and/or removes the conventional incremental weight product from a starting resistance.

The magnet used in the micro-weights according to the disclosure have top and bottom surfaces and are typically sized such that a single magnet can be disposed in the aperture and the top surface of the magnet is substantially flush with one of the first and second surfaces of the annular body and the bottom surface of the magnet is substantially flush with the other of the first and second surfaces of annular body.

The magnet 16 can be formed, for example, of neodymium. Neodymium metal is strongly magnetic having sixty electrons per atom. In comparison, iron has twenty-six electrons per atom and nickel has twenty-eight electrons per atom. In various embodiments, the magnet 16 can be a super magnet and formed of an alloy comprising neodymium, iron, and boron. Other magnetic materials can also be used.

The magnet 16 can have a diameter that is substantially the same as the diameter of the aperture 14 to provide an interference fit between the inner surface 28 of the aperture 14 and the magnet 16 such that there is sufficient force to retain the magnet 16 within the aperture 14 when the micro-weight 10 is separated from a weight lifting apparatus and/or another micro-weight 10. As used herein, "interference fit" refers to the smaller diameter of the aperture 14 (or the diameter of a portion of the aperture 14) relative to the diameter of the magnet 16. The interference fit can be provided, for example, by a difference between the diameters of the aperture 14 and the magnet 16 of 0.005 inches or less, 0.004 inches or less, 0.003 inches or less, 0.002 inches or less, 0.001 inches or less, or 0.0015 inches or less.

The magnet 16 can have a diameter dm of about 0.1 inches to about 1 inch, about 0.2 inches to about 0.9 inches, about 0.3 inches to about 0.8 inches, about 0.4 inches to about 0.7 inches, about 0.5 inches to about 0.6 inches, about 0.1 to about 0.4 inches. Other suitable diameters include, for example, about 0.1, 0.15, 0.2, 0.25, 0.3, 0.35, 0.4, 0.45, 0.5, 0.55, 0.6, 0.65, 0.7, 0.75, 0.8, 0.85, 0.9, 0.95, and 1 inch. In one embodiment, the micro-weight 10 has a thickness of about 0.39 inches. In another embodiment, the micro-weight 10 has a diameter of 0.5 inches.

In some embodiments, including embodiment in which the aperture 14 includes a reduced diameter portion (relative to the diameter of the rest of the aperture 14), the magnet 16 can have a thickness that is substantially the same as the thickness of the micro-weight 10, such that opposed end surfaces of the magnet 16 are substantially flush with the first and second surfaces 18, 20 of the micro-weight 10. In other embodiments, including embodiments in which the aperture 14 includes a reduced diameter portion (relative to the diameter of the rest of the aperture 14), the magnet 16 may have a thickness that is slightly less than the thickness of the micro-weight 10, such that one end of the magnet 16 terminates at the reduced diameter portion and the opposed end of the magnet 16 terminates at the opposed side of the micro-weight 10.

Assembly of the Micro-Weight

The micro-weights can be assembled by inserting the magnet 16 into the aperture 14. The magnet can be retained in the annular body using any known methods, including, for example, dimensioning the aperture to allow the magnet 16 to be press-fit into annular body 12. For example, the diameter of the aperture can be substantially the same as the diameter of the magnet. As is known in the art, press-fitting refers to a fastening between the annular body and the magnet that is achieved by friction after the parts are pushed together by the press-fitting operation.

The friction that holds the magnet 16 and the annular body 12 together can be increased by compression of the magnet 16 against the annular body 12, for example, by reducing the diameter ds of at least a portion of the aperture 14 relative to the magnet diameter dm. For example, the portion of the aperture 14 with a diameter ds can be smaller than the diameter dm of the magnet 16 by about 0.001 inches to about 0.005 inches, about 0.002 inches to about 0.004 inches, about 0.001 inches to about 0.003 inches, or about 0.002 inches to about 0.005 inches. Other suitable differences in diameter include, about 0.001, 0.0015, 0.002, 0.0025, 0.003, 0.0035, 0.004, 0.0045, 0.005 inches. For example, the diameter of the aperture can be reduced by including a shoulder 26 extending inwardly from an interior surface of annular body into the aperture 14 such that a portion of the diameter of the aperture is reduced. In one embodiment, for example illustrated in FIG. 4, the shoulder 26 can have a surface which is coplanar with one of the first and second side surfaces 18, 20 of the annular body.

Figure 4:
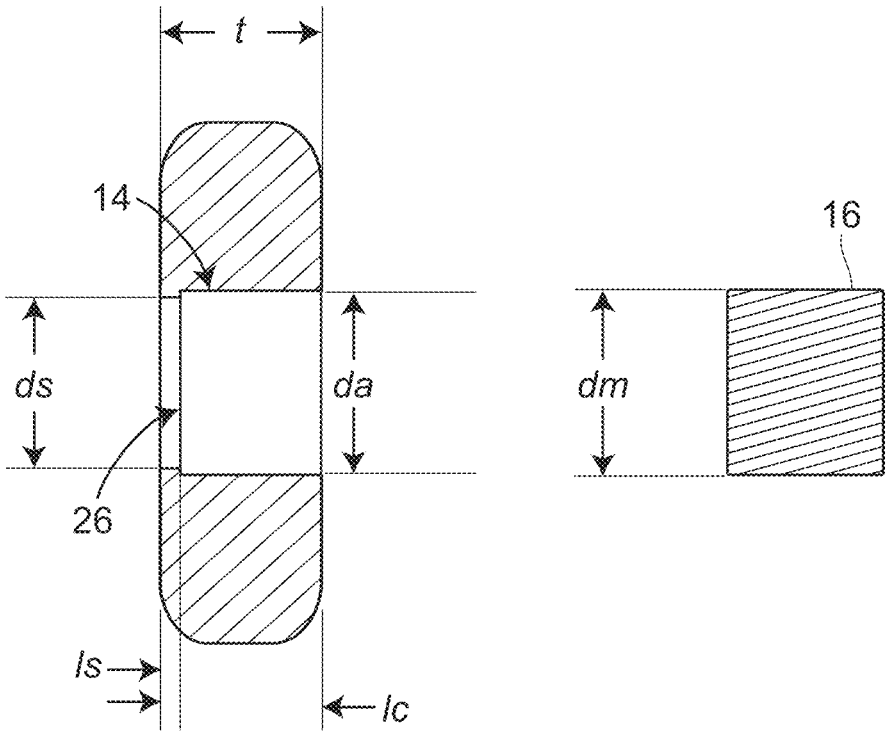
FIG. 4 is a cross-sectional side view of a micro-weight in accordance with an embodiment of the disclosure having a shoulder disposed in the aperture.

The reduced diameter portion can be disposed through only a portion of the thickness of the aperture 14. Referring to FIG. 4, the length of the reduced diameter portion corresponds to the length is of the region in the aperture 14 in which the magnet 16 will undergo increased stress so as to enhance press fitting. The diameter of the remaining portion lc of the aperture 14 can be sized to be slightly greater by, for example, about 0.001 inches than the diameter dm of the magnet 16 to allow a reduced stress insertion region. In various embodiments, the remaining portion lc of the aperture can be sized to have a diameter that is the same as or substantially the same as the diameter of the magnet. Use of a reduced diameter portion extending only partially through the aperture advantageously reduces the region of stress on the magnet 16, while providing sufficient interference fitting for retention of the magnet 16 in the annular body 12 during use. Thus, the likelihood of breakage of the magnet 16 during insertion into the aperture 14 can be reduced. For example, the reduced diameter portion can extend from a side surface of the annular body 12 into the aperture by about 0.01 inches to about 0.5 inches, about 0.04 inches to about 0.2 inches, about 0.05 inches to about 0.1 inches, and about 0.07 inches to about 0.08 inches. For example, the reduced diameter portion can extend about 0.01, 0.02, 0.03, 0.04, 0.05, 0.06, 0.07, 0.08, 0.09, 0.1, 0.15, 0.0.12, 0.125, 0.13, 0.135, 0.14, 0.145, 0.15, 0.155, 0.16, 0.165, 0.17, 0.175, 0.18, 0.185, 0.19, 0.195, 0.2, 0.3, 0.4, or 0.5 inches from a side surface of the annular body 12 into the aperture 14.

Methods of using the Micro-Weights to Incremental Increase Strength

The micro-weights can be applied to any conventional weight training apparatus to provide small incremental increases in exercise resistance for safe and continuous strength gains. For example, a user can select an initial resistance and perform a desired exercise using the initial resistance. One or more micro-weights having the desired incremental increase in resistance can be magnetically attached to the exercise apparatus during subsequent workouts to incrementally increase the exercise resistance when subsequently performing the exercise, thereby incrementally increasing the user's strength without injury and/or failure. Overtime, the incremental increase can be selected such that the user can successfully perform the exercise with proper form and without undue strain. As the overall weight of the exercise increases over time, the incremental increases applied during subsequent workouts can be decreased if needed to maintain proper form and safe strengthening of muscles, tendons, and ligaments.

The micro-weights can also be successfully applied to rehabilitation programs. As a result of receiving less blood flow, ligaments heal more slowly than tendons, and tendons heal more slowly than muscles. In order to rebuild all injured tissues, but especially ligaments and tendons, very small weight increases should be used. Once an appropriate starting exercise intensity is identified, a first incremental increase in weight resistance might be as little as one quarter-ounce. As the damaged tissue rebuilds itself and becomes stronger, the incremental increase in weight resistance (which is made in each successive workout) will be easier for the damaged tissues to handle. At this point, the incremental increase in weight resistance can be adjusted upwards, perhaps to one half-ounce. As the damaged tissue rebuilds itself and continues to grow in strength, small incremental adjustments to the increases in exercise intensity can be made to allow the damaged tissue to rebuild and strengthen while the weight training exercise remains easy to perform with good weight training form. By using such small incremental weight increases, the chances of reinjuring the damaged tissues are substantially reduced. The rehabilitative program should be continued until the full range of motion is restored, the strengths of the muscles, ligaments, and/or tendons are equal on both sides of the body, and the injured tissue is fully repaired.

The micro-weights can be particularly useful in the strengthening of smaller muscular groups such as the forearm. The forearm includes a large number of muscles, tendons, and ligaments and strengthening of the forearm requires strengthening of each of the individual tissues including larger and smaller muscular group that control finger and wrist movement to ensure proper and injury-free strengthening of the forearm, while maintaining full range of motion of the wrist and fingers. Strengthening each of these tissue groups in balance can be successfully achieved by utilizing the micro-weights of the disclosure to provide small incremental increases in exercise resistance, thereby allowing each muscular group to slowly strength over time without failure and without compensation by larger muscular groups at the detriment of smaller muscular groups.

EXAMPLES

Example 1

¼ Ounce Micro-Weight

A micro-weight 10 having a mass of ¼ ounce was manufactured and had a thickness of about 0.32 inches and a diameter of about 0.475 inches. The outer radiused edge 22 of the annular body 12 had a radius of about 0.0480 rads. The aperture 14 had a diameter of about 0.3125 inches and extended through the entire thickness of the micro-weight 10. The magnet 16 had a diameter of about 0.3125 inches and thickness of about 0.313 inches. The magnet 16 also included radiused edges having a radius of 0.032 rads.

Example 2

½ Ounce Micro-Weight

A micro-weight 10 having a mass of ½ ounce was manufactured and had a thickness of about 0.5 inches and a diameter of about 0.55 inches. The outer radiused edge 22 of the annular body 12 had a radius of about 0.0930 rads. The aperture 14 had a diameter of about 0.25 inches and extended through the entire thickness of the micro-weight 10. The magnet 16 had a diameter of about 0.25 inches and thickness of about 0.5 inches, such that it extended through the entire thickness of the micro-weight 10. The magnet 16 also included radiused edges having a radius of 0.032 rads

Example 3

1 Ounce Micro-Weight

A micro-weight 10 having a mass of 1 ounce was manufactured and had a thickness of about 0.39 inches and a diameter of about 0.8680 inches. The outer radiused edge 22 of the annular body 12 had a radius of about 0.0780 rads. The aperture 14 had diameter of about 0.3750 inches and extended through the entire thickness of the micro-weight 10. The aperture 14 included a reduced diameter portion inwardly extending about 0.015 inches from a side of the micro-weight 10 into the aperture 14. The magnet 16 had a diameter of about 0.3750 inches and thickness of about 0.375 inches, such that it extended through aperture 14 to the reduced diameter portion. The magnet 16 also included radiused edges having a radius of 0.032 rads. The micro-weight 10 included a recessed portion 24 disposed between the outer radiused edge 22 of the annular body 12 and the aperture 14 on each side of the micro-weight 10. The recessed portion 24 was recessed by a distance of about 0.070 inches as compared to the outer radiused edge 22.

Example 4

2 Ounce Micro-Weight

A micro-weight 10 having a mass of 2 ounce was manufactured and had a thickness of about 0.39 inches and a diameter of about 1.24 inches. The outer radiused edge 22 of the annular body 12 had a radius of about 0.125 rads. The aperture 14 had a diameter of about 0.439 inches and extended through the entire thickness of the micro-weight 10. The aperture 14 included a reduced diameter portion inwardly extending about 0.14 inches from a side of the micro-weight 10 into the aperture 14. The magnet 16 had a diameter of about 0.4375 inches and thickness of about 0.375 inches, such that it extended through aperture 14 to the reduced diameter portion. The magnet 16 also included radiused edges having a radius of 0.032 rads. The micro-weight 10 included a recessed portion 24 disposed between the outer radiused edge 22 of the annular body 12 and the aperture 14 on each side of the micro-weight 10. The recessed portion 24 was recessed by a distance of about 0.070 inches as compared to the outer radiused edge 22, and had a diameter of about 0.938 inches.

Although the foregoing text is a detailed description of numerous different embodiments of a micro-weight or set of micro-weights for incrementally increasing weight and method of using the same in accordance with the disclosure, the detailed description is to be construed as exemplary only and does not describe every possible embodiment in accordance with the disclosure. Consequently only such limitations as appear in the appended claims should be placed on the invention.

What is claimed:

1. A set of micro-weights comprising:

at least three disc-shaped micro-weights having a different mass, each micro-weight comprising:

an annular body comprising a first surface and a second surface, the annular body defining a substantially central aperture extending from an opening in the first surface entirely through the annular body to an opening in the second surface, wherein each surface terminates in a radiused edge; and a magnet disposed in the central aperture, wherein each micro-weight has a mass of about ¼ ounce to about 2 ounces.

2. The set of claim 1, wherein the magnet comprises a super magnet.

3. The set of claim 1, wherein the magnet comprises neodymium.

4. The set of claim 3, wherein the magnet further comprises iron and boron.

5. The set of claim 1, wherein the magnet has top and bottom surfaces and is disposed in the aperture such that the top magnet surface is substantially flush with one of the first and second surfaces of the annular body and the bottom surface of the magnet is substantially flush with the other of the first and second surfaces of annular body.

6. The set of claim 1, wherein the annular body is non-magnetic.

7. The set of claim 1, wherein the annular body comprises stainless steel.

8. The set of claim 1, wherein the radiused edge has an arc length of about 0.01 rads to about 0.2 rads.

9. The set of claim 1, wherein one or both of the first and second surfaces have a recessed portion disposed between the radiused edge and the aperture.

10. The set of claim 1, wherein the aperture has a cylindrical shape.

11. The set of claim 1, wherein a portion of the aperture has a diameter greater than a diameter of the magnet.

12. The set of micro-weights of claim 1, comprising one or more pairs of micro-weights, each of the micro-weights of a pair having the same mass.

13. The set of micro-weights of claim 1, comprising:

a first micro-weight having a mass of ¼ ounce;

a second micro-weight having a mass of ½ ounce;

a third micro-weight having a mass of 1 ounce; and a fourth micro-weight having a mass of 2 ounces.

14. The set of micro-weights of claim 1, comprising:

a first pair of micro-weights, each micro-weight of the first pair of micro-weights having a mass of ¼ ounce;

a second pair of micro-weights, each micro-weight of the second pair of micro-weights having a mass of ½ ounce;

a third pair of micro-weights, each of the micro-weights of the third pair of micro-weights having a mass of 1 ounce; and a fourth pair of micro-weights, each of the micro-weights of the fourth pair of micro-weights having a mass of 2 ounces.

15. A method of incrementally increasing a person's strength by incremental weight training, comprising:

selecting an initial resistance; and magnetically attaching a first micro-weight having an incremental mass of about ¼ ounce to about 2 ounce to the initial resistance to provide a first incrementally increased resistance and subsequently executing the weight training exercise using the first incrementally increased resistance, thereby achieving an incremental gain in strength without causing injury and/or failure, wherein:

the micro-weight comprises an annular body comprising a first surface and a second surface, the annular body defining a substantially central aperture extending from an opening in the first surface entirely through the annular body to an opening in the second surface, each surface terminating in a radiused edge, and a magnet disposed in the central aperture for magnetically attaching the micro-weight to the initial resistance.

16. The method of claim 15, further comprising magnetically stacking a second micro-weights onto the first micro-weight to provide a second incrementally increased resistance and subsequently executing the weight training exercise with the second incrementally increased resistance, thereby achieving an additional incremental gain in strength without causing injury and/or failure, wherein when magnetically stacking the second micro-weight onto the first micro-weight the respective magnetic poles of the micro-weights align the stacked micro-weights such that the first and second micro-weights are releasably coupled.

17. A micro-weight training apparatus consisting of:

one or more disc-shaped micro-weights, each micro-weight comprising:

an annular body comprising a first surface and a second surface, the annular body defining a substantially central aperture extending from an opening in the first surface entirely through the annular body to an opening in the second surface, wherein each surface terminates in a radiused edge; and a magnet disposed in the central aperture, wherein each micro-weight has a mass of about ¼ ounce to about 2 ounces.

* * * * *